United States Patent [19]

Reed

[11] Patent Number: 4,590,720

[45] Date of Patent: May 27, 1986

[54] TELESCOPING DERRICK

[75] Inventor: Lowell M. Reed, Moore, Okla.

[73] Assignee: Parco Mast and Substructure, Inc., Tulsa, Okla.

[21] Appl. No.: 577,534

[22] Filed: Feb. 6, 1984

[51] Int. Cl.[4] ..... B66C 23/06

[52] U.S. Cl. ..... 52/121; 52/632; 254/336

[58] Field of Search ..... 52/121, 632, 125.1, 52/118; 212/267; 254/335, 336, 327, 326

[56] References Cited

U.S. PATENT DOCUMENTS

| | | | |
|---|---|---|---|
| 2,763,339 | 9/1956 | North | 52/121 |
| 3,000,473 | 9/1961 | Reynolds | 52/121 |
| 3,327,997 | 6/1967 | Zenke | 52/125.1 X |
| 3,366,407 | 1/1968 | Cernosek | 52/121 X |

*Primary Examiner*—Carl D. Friedman

*Attorney, Agent, or Firm*—Head, Johnson & Stevenson

[57] ABSTRACT

A heavy duty drilling mast or derrick made of a plurality of elements which telescope one into another so that the derrick can be raised from a collapsed position to an extended position with vertical axis by means of a plurality of four cables—one in each corner of the derrick. Each element is a rectangular box with open top and bottom, and each element can be locked to its upper and lower neighbors in the extended position so as to provide a strong, rigid derrick for drilling deep wells. Each element can be removed from the assembly and carried by helicopter from one location to another.

9 Claims, 17 Drawing Figures

TELESCOPING DERRICK

BACKGROUND OF THE INVENTION

1. Field of the Invention:

This invention lies in the field of drilling masts or derricks for deep boreholes, such as those drilled for the production of hydrocarbon gases and liquids. More particularly, it concerns a type of construction in which the derrick can be transported simply and reliably and yet can be, with minimum effort, raised with cables into an extended vertical position and locked with removable drive pins.

2. Description of the Prior Art:

There have been many designs of large drilling derricks which can support tremendous weights of pipe in the hole. However, all of the designs for large masts have been of the so-called jackknife type where pieces of the derrick are laid out on the ground and assembled piece-by-piece into the final mast or derrick structure. By hinging two of the four legs to corresponding points on a base structure on the ground and by using special cable arrangements, the derrick is lifted from a horizontal into a vertical position. The erection of these large masts must be without the use of separate lifting cranes, which would not be available in the areas where the derrick would be used.

Other types of derricks or masts have been built by assembling the derrick structure piece-by-piece in a vertical position by means of a crane to lift the various pieces of the assembly to the topmost position of the derrick. Again, such large cranes that would be needed would not be available in most of the areas where such a large derrick would be required. Therefore, this unique method of assembling everything on the ground in a collapsed form and then raising and extending the telescoping sections offers an entirely new freedom in the design and the strength of the structure.

SUMMARY OF THE INVENTION

It is a primary object of this invention to provide a telescoping derrick or mast for use in drilling deep boreholes in the earth.

It is a further object to provide the derrick in a plurality of sections, each of similar cross-sectional shape but of different dimension so that one may slide within the other, and thus a plurality of elements can fit together so that the lowermost element surrounds all of the others.

These and other objects and advantages of the invention are realized and the limitations of the prior art are overcome in this invention by providing a plurality of derrick sections. Each of these sections is in the form of a rectangular parallelpiped or simply as a rectangular box open at top and bottom. Each of the four walls need not be a solid structure, but can be made up of a plurality of bars, rods, channels, angles, etc. welded together and properly braced so as to make a rigid assembly.

Each section of the derrick is of identical shape to those on top and bottom, but is of lesser horizontal dimension than the one below and of greater dimension than the one above. Thus, each of the derrick sections can slide freely within the next lower element in the structure. Four separate lifting cables are provided, one of which operates in each corner of the structure. A lifting cable is threaded through sheaves on each of the interpositioned elements. Means are provided for locking the elements together in pairs so that when the derrick is extended, it can be made into a rigid structure, capable of supporting a great weight of drill pipe, etc.

One element is lifted with respect to the lower one by means of lifting cables in each corner. Particular means are provided for driving the drums which carry these four cables at a selected speed so that each of the cables is synchronous with each of the others. That is, when one cable moves one foot, each of the other three cables must move an equal distance so as to cause the two derrick elements which are being separated to move parallel to each other as they separate and become extended. Otherwise, there will be difficulties from binding and twisting. These means include separate drums and separate engine drives through hydraulic means, with servo-control so as to gauge the speed of each drum in accordance with the speed of cable movement of each of the other drums.

BRIEF DESCRIPTION OF THE DRAWINGS

These and other objects and advantages of this invention and a better understanding of the principles and details of the invention will be evident from the following description taken in conjunction with the appended drawings, in which.

DESCRIPTION OF THE PREFERRED EMBODIMENT

Figure 1:
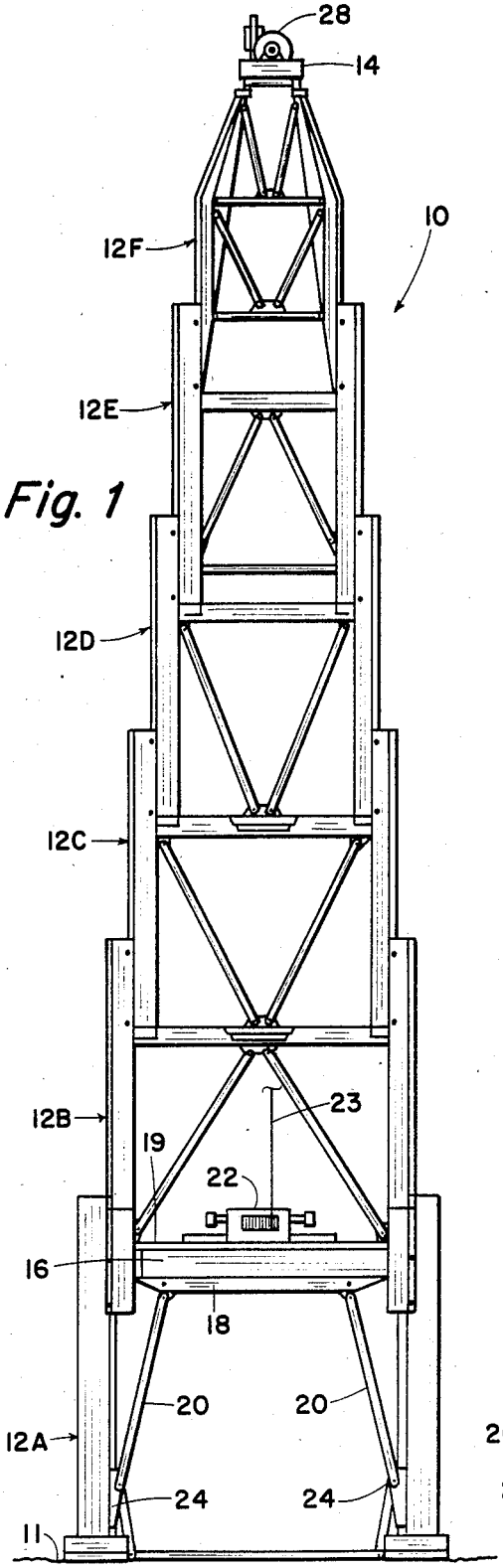
FIGS. 1 and 2 represent two views of the mast or derrick of this invention in an upright extended position.
Figure 2:
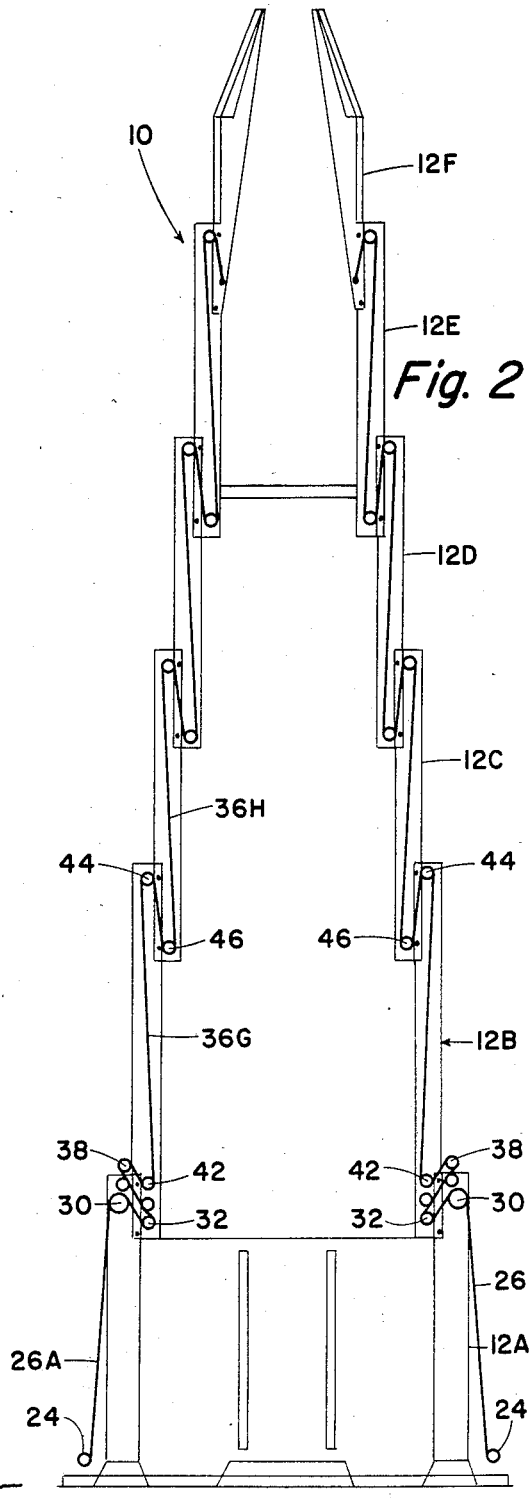

Referring now to the drawings and in particular to FIGS. 1 and 2, there are shown two views of the completed derrick in side elevation. FIG. 1, illustrated by the numeral 10, shows the entire structure. While any number of separate telescoping elements can be used, the number of elements will be determined by the demands to be made of the mast and the magnitudes of supporting weights and also a measure of the individual weight of each section or element such that can be carried by helicopter, or carried by truck over the road, and so on. The design using six elements (N=6) is a matter of choice and has no relation to limits of the lower side or the higher side of the number of sections that can be used.

FIG. 1 shows six sections. The first section is also the base unit 12A and rests upon the ground 11 with suitable foundation as is well known in the art. The second section 12B is shown extended inside of the first section and so on until the Nth or top section 12F is shown. On top of the top section is the crown block 14 with the plural sheaves or pulleys 28.

The main working floor 19 of the derrick is the floor at the bottom of the second section 12B. As will be shown, the work floor houses the drawworks, rotary table and engines. It also supports all the weight of the racked drill pipe and drill collars. Consequently, a very strong support is needed for the working floor. This is provided by means of a subfloor 18 which is supported on columns 20, which are supported at the base of the corner columns 12A of the first section.

Shown in FIG. 1 is the drawworks 22, and fast-line cable 23.

Figure 3:
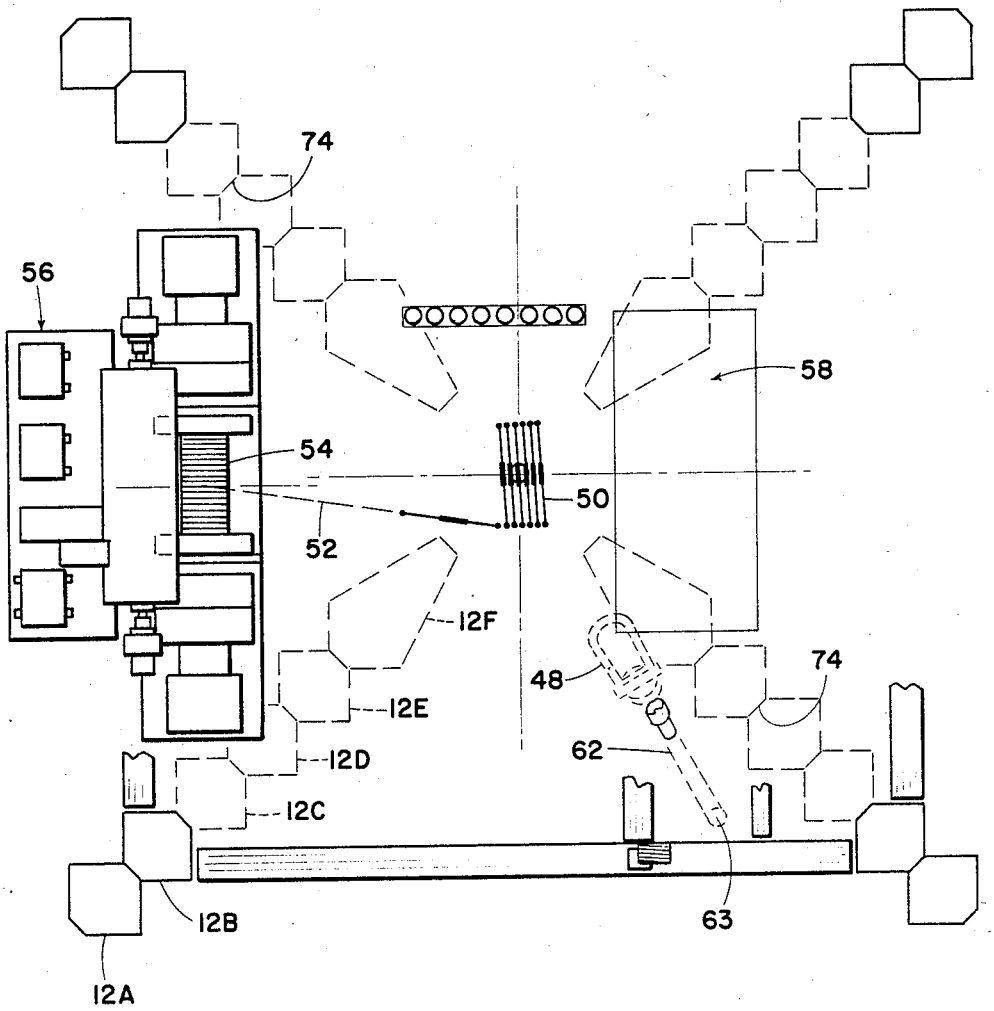
FIG. 3 represents a partial plan view of the derrick viewed from above the crown block.

Great detail of the individual sections or elements is not required since each designer would design it in a slightly different way, each of which would be equally useful. However, as is shown in FIG. 3, each of the sections are parallelepipeds. Each of the side walls are rectangular and can of course be in the form of squares to make a section itself of substantially cubic construction. Each of the sections comprises four corner columns spread apart by means of beams at top and bottom. These columns and beams can be made of built-up sections of smaller rolled steel forms such as angles, I-beams, tubing, etc. In very cold climates it is possible to support thin metal or fabric composition walls to each of the sides so that the tower will be substantially enclosed when in an extended position. This covering would be primarily for the protection of the workmen and would not have a very important part in the operation of the entire derrick.

Figure 4:
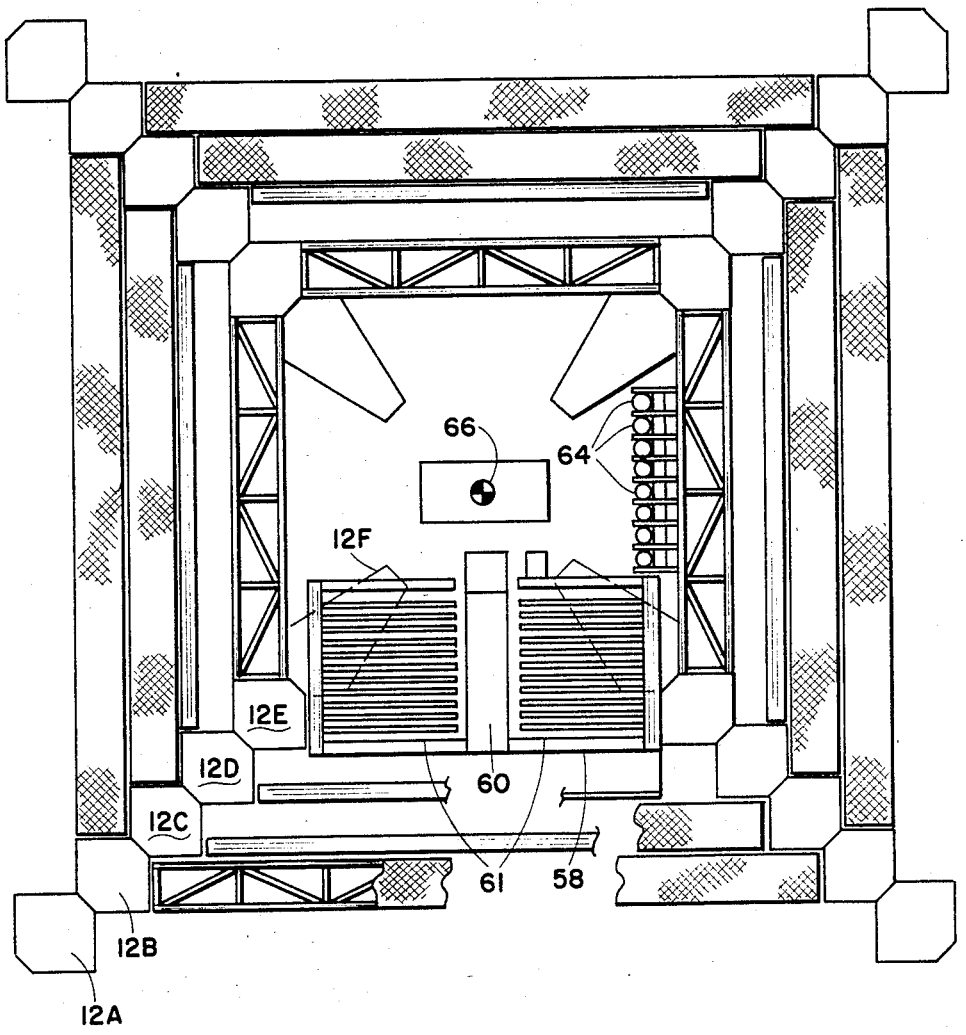
FIG. 4 represents a view of the derrick at an elevated position, below the crown block, for the purpose of showing the racking board and the racking arrangement for the drill collars.

Referring now to FIGS. 3 and 4, there are shown two plan views of the derrick. FIG. 3 is a partial plan view of the derrick, taken from a horizontal plane above the top of the crown block. Also shown are the drawworks 56 with drum 54 and fastline cable 52 going to the crown blocks 50. The tops of each of the corner columns of each of the sections are shown.

FIG. 4 shows a little more detail of the horizontal beams that support and space the tops and bottoms of the four corner columns. Further detail of the columns will be shown later because they are an important part of the structure.

FIGS. 3 and 4 both show the tops of the corner columns of each of the elements of the derrick. The normal square or rectangular shape of the columns is distorted by cutting away opposite corners of the column so that the columns on one element will mesh with the columns on the adjacent elements along the narrow wall where the corners are cut off.

The pairs of elements that slide with respect to each other are guided by means of a welded plate of suitable dimension. These press against the angles which form the corners of the columns in each corner of each section. On the opposing column would be placed a plurality of metal plates of the proper thickness to fit in between this channel type track. Only two, or at the most three, guiding plates would be required. When the elements were nested all three of the plates would be within the track of the adjacent element. As the inner element is raised, the top guide plate extends beyond the top of the column of the lower element so that there are still two plates which are positioned at the top and the bottom of the lower section of a column which provides a selected length where there is overlap between the two adjacent corner columns to give the tower sufficient stability.

This extra pulling force is desirable because as shown in FIG. 1 the working floor 19 of the mast is at the bottom of the second section. As previously mentioned, the weight of the drawworks block, the rotary table mechanism, the interior mast sections, the electric motors, and all necessary drilling equipment are all standing on the derrick floor. This extra tension in the cable is required to lift all the structured sections, plus the weight of all the equipment, and so forth.

Other than the mechanical construction of the individual elements so that there are the proper clearances and they are properly guided there are several features that are very important, such as, for example, how to raise the individual sections one inside the other in order to get the entire mast extended. One embodiment of such a mechanism would be to use a plurality of drums with a plurality of lifting cables, one for each of the four corners of the mast, to do the lifting. There is a special requirement here that the separate cables that are used for lifting the sections all travel at the same rate so that as a section is lifted with respect to its neighbor it will move parallel to itself. Thus there will be no binding or twisting such as might happen if, for example, one corner was lifted faster than the other opposite corner. Also, means must be provided to lock the individual elements, one inside of the other so that as the lifting proceeds there is no danger that a section will be lifted entirely outside of the one below it because that would cause considerable trouble and lost time to say the least. Details of the control means for the lifting cables will be described later in connection with FIGS. 14 and 15.

FIG. 2 is illustrated principally for the purpose of illustrating the manner in which the individual sections are lifted.

At any desired position an engine and cable drum are provided one for each corner of the first or base section. At the top of the corner post in the first section are a group of three pulleys or sheaves. In the base of the second element are a corresponding group of three sheaves or pulleys. This is shown in enlarged form in FIG. 6. The cable from the drum is identified by the numeral 26A and goes up over the pulley 30 near the top of the first corner column. A cable 26A goes over that pulley 30 as 26B. It then goes under pulley 32 and then up and under an idler 34 as 26D, and over another idler 36 at the top, and as 26E goes over the top of the center pulley 38 at the top of the corner column 12A. The cable comes off of the pulley 38 as 26F and goes under pulley 42 and up to the top pulley on the next adjacent corner column.

Figure 8:
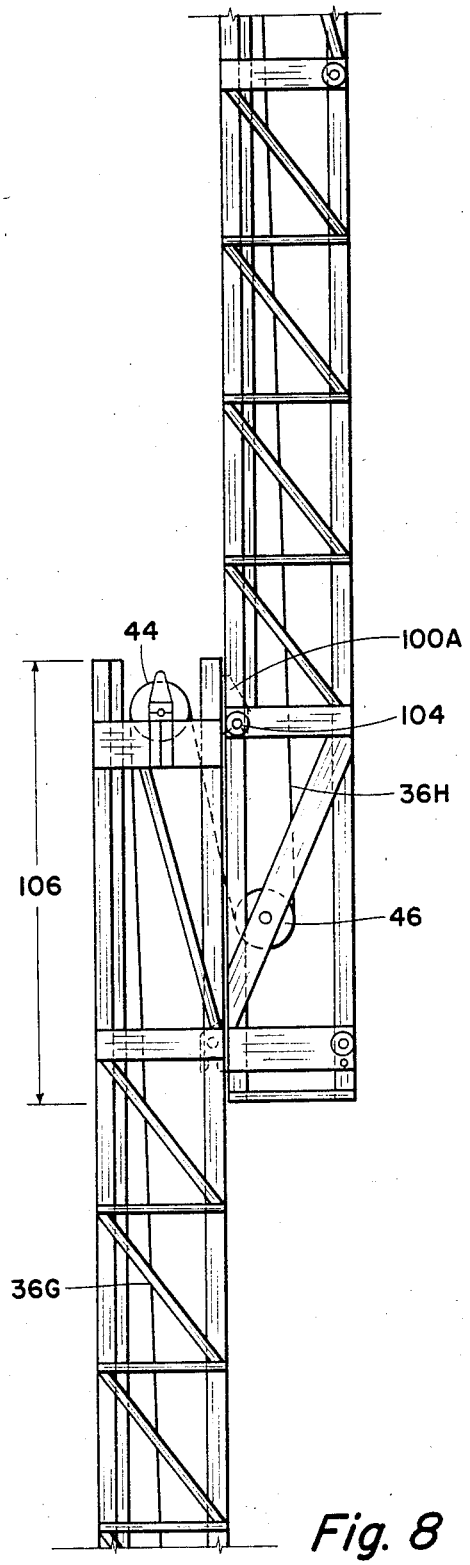

Turn to FIG. 8 for a moment, which illustrates the second and third elements. In this case there are only two pulleys involved at each junction. There is one pulley 44 on top of a corner column and another pulley 46 at the bottom of the inner adjacent corner column. By looping the cable over the pulley 44 and under the pulley 46 a downward force on the cable 36G can raise the interior element.

This is shown in FIG. 2, where each of the pairs of columns, the outer and the inner sections, cooperate with each other and two pulleys to permit raising all the sections by a continuous pull on the cable 26A at the drum 24.

The purpose of the multiple pulleys at the top of the first section and the bottom of the second section is to provide a three-to-one force multiplication. This is provided by having another pair of support cables lifting the second section with respect to the top of the first section.

This extra pulling force is desirable because as shown in FIG. 1 the working floor 19 of the mast is at the bottom of the second section. As previously mentioned, the weight of the drawworks, the rotary table mechanism and the engines, the weight of the racked pipe and the drill collars also are all standing on the derrick floor. This extra tension in the cable is required to lift all the structured sections, plus the weight of all the equipment, and so forth.

It may be desirable in assembling this mast to arrange for a given order of raising of each of the several sections. For example, it has been found desirable to lift the second section with the other four sections nested inside of it.

The normal mode of operation where each of the sections is nested together is for the force to first lift the lightest load which would be the top or the Nth or sixth section. Consequently, if the first element to be lifted is desired to be the second element, then each of the others must be locked in position with respect to their associated adjacent elements. The element that is not locked, of course, will be the one that is lifted, even though it supports more weight than any of the other elements.

It is desirable in the driving system for each of these four drums to interpose a hydraulic torque transmission or hydrostatic drive. No details are shown for the hydrostatic drive of the lifting cable drums since these are commercial items and can be bought over the counter. Also, some type of visual display is desired to show the relative rates of motion of each of the cables. One way of doing this, of course, is to use the Selsyn or other system of transmission of angular motion between a pulley of the driving system, as the cable pays out to lower the sections or as the cable is reeled in, in order to lift the sections. Each of these four Selsyn generators can drive a corresponding Selsyn receiver, or motor, which will turn precisely through the angle that the pulley turns. The operator then can watch each of these four motors to see that they move through equal angles in equal time. To further improve this system might be to interpose a differential Selsyn system which represents the rotation of each of three of the cable pulleys with respect to the fourth one. The differential motor then would show the precise difference in angular motion of the pulley, or the linear motion of the cable, which is the quantity of interest. No further detail need be described relative to the Selsyn system, differential Selsyn motor, etc., since these devices are described in the literature.

Referring again to FIG. 3, the purpose of which is to note the plan view of the working floor of the mast, the arrangement of apparatus is substantially the same as in conventional operations. The rat hole 63 is provided for the Kelly 62 and swivel 48. A set back floor 58 is provided for the stands of drill pipe which will be lifted out of the well 66 (FIG. 4) and racked in the racking boards 61. The catwalk 60 provides space for the workman in the mast to move the stands of drill pipe into each of the slots until all the pipe is racked.

Figure 9A:
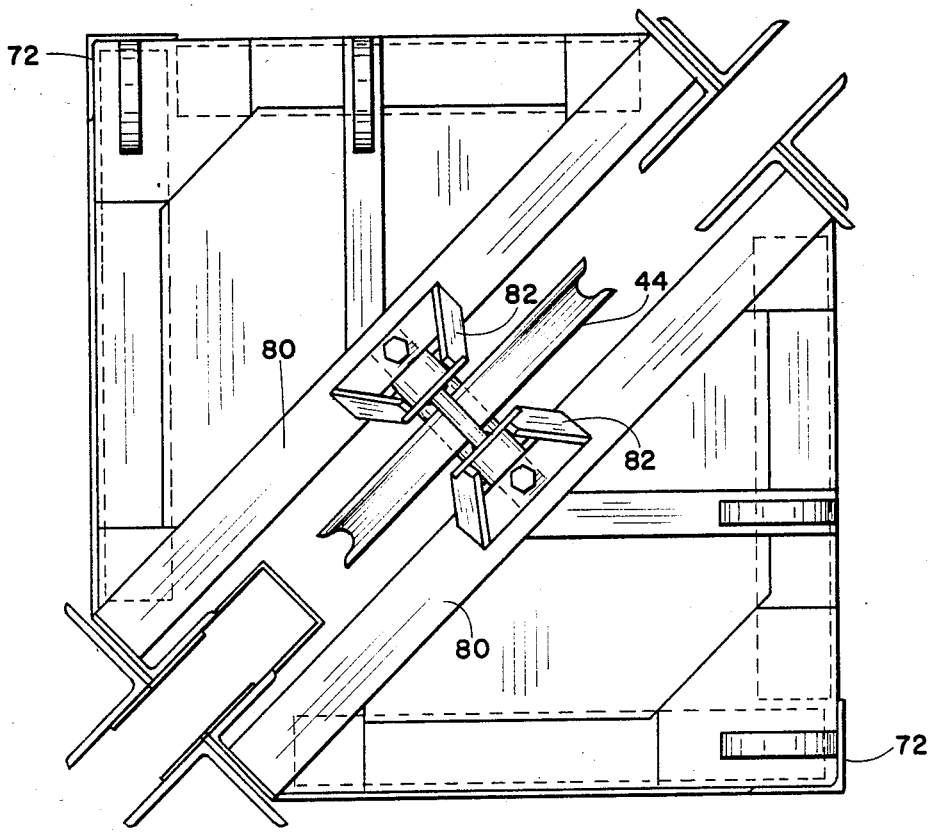
FIGS. 9A, 9B and 9C illustrate details of the top of one corner column of an intermediate element of the nest.
Figure 9B:
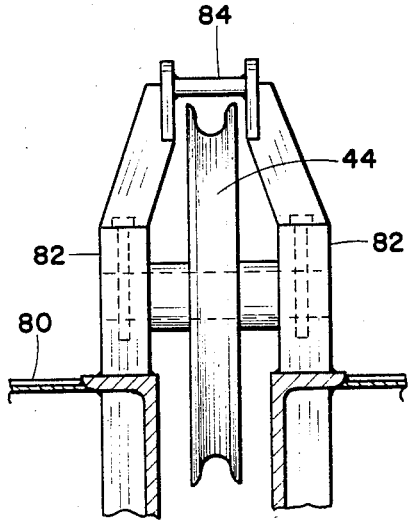
Figure 9C:
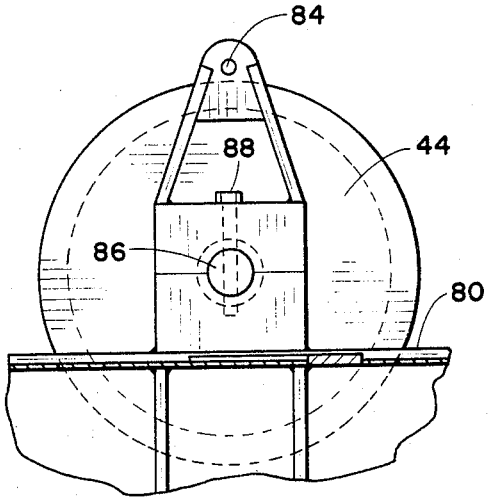
Figure 10:
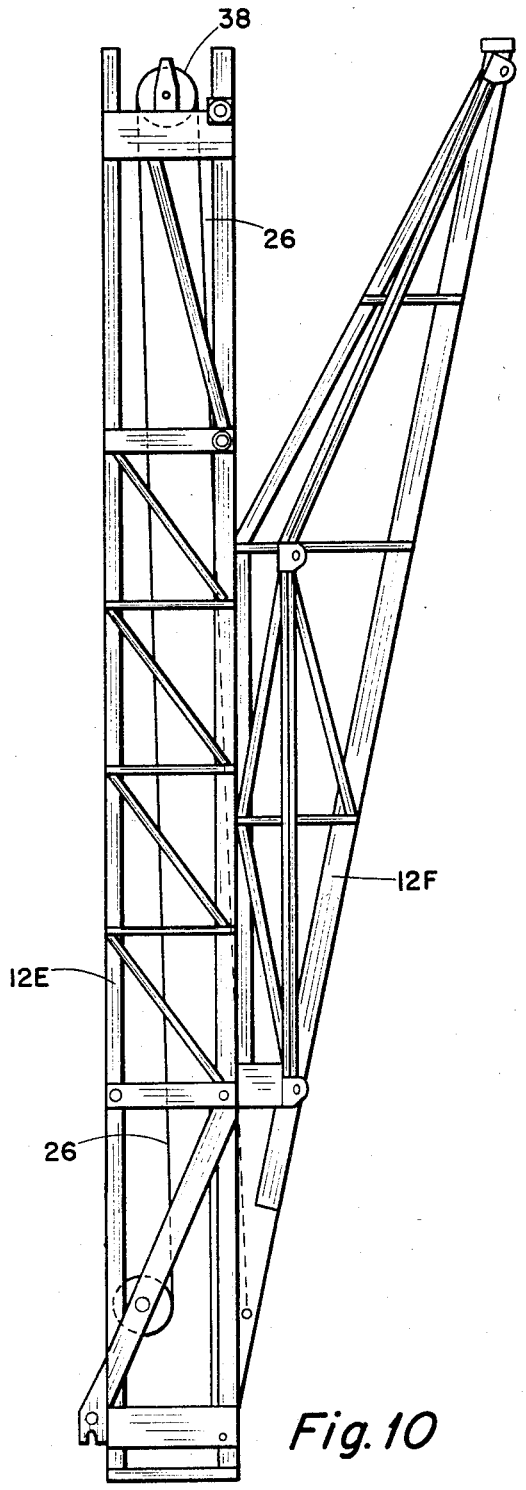
FIG. 10 illustrates a side view of a corner column of the (N−1)th and the Nth or top section nested.
Figure 11:
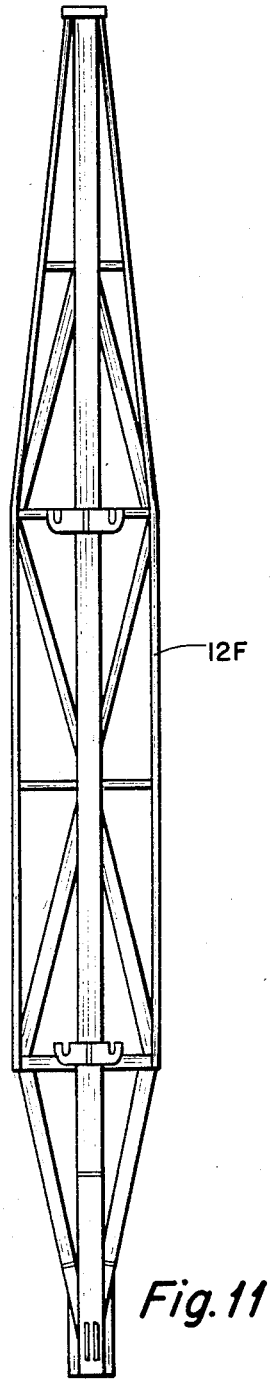
FIG. 11 illustrates a view of a corner column for the top section.

FIG. 9A illustrates a plan view parallel to the top of the corner column of a given element. Two corners 74A and 74B are cut away and a beam structure 80 provided to support a pulley or sheave 44.

The pulley 44, which is used for the lifting cable and by which each of the sections using its own pulley is lifted or lowered, is mounted on a diagonal as shown. Thus, all of the pulleys 44 will be in the same plane and the cable that goes up and down between the various pulleys will lie in the same plane as the pulleys themselves. The pulley has an axle that runs in the bearings supported by the two beams 80 and the shaft on which the wheel runs is locked in position.

Figure 5:
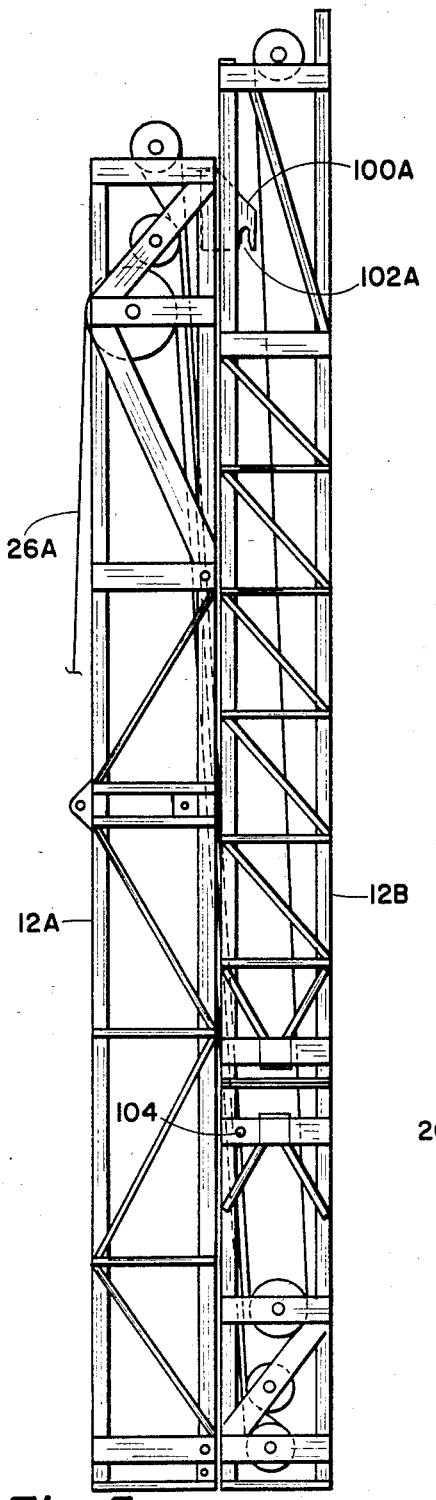
FIGS. 5 and 6 show a corner of the first or base section and a corner of the second section, where the second section is nested inside of the first section and in FIG. 6 where the second section or element is in an extended position.
Figure 6:
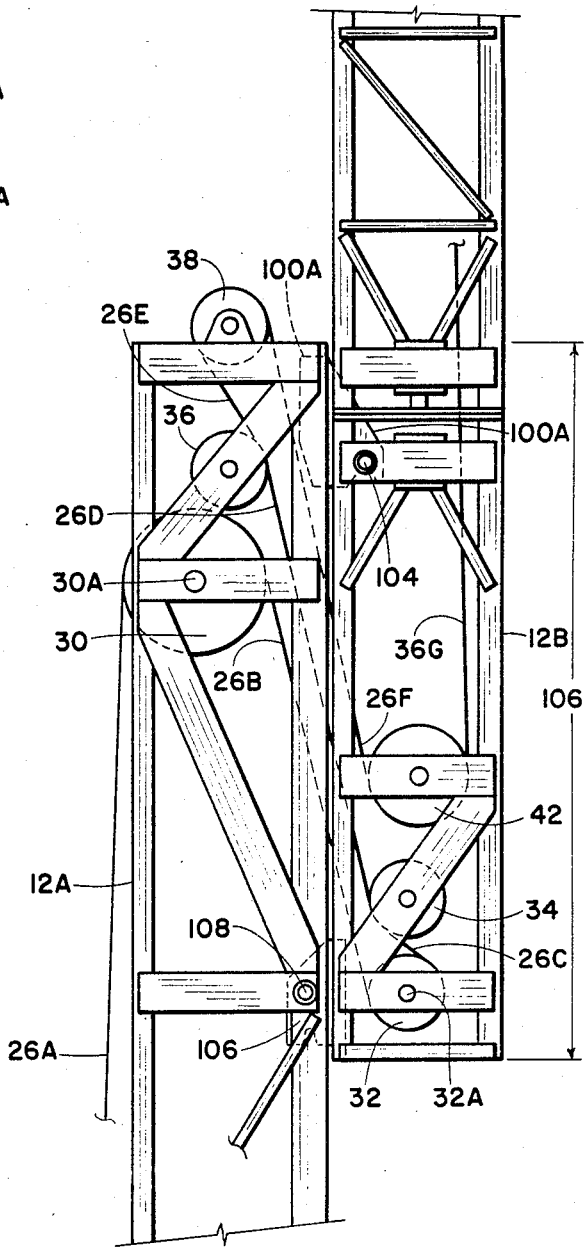
Figure 7:
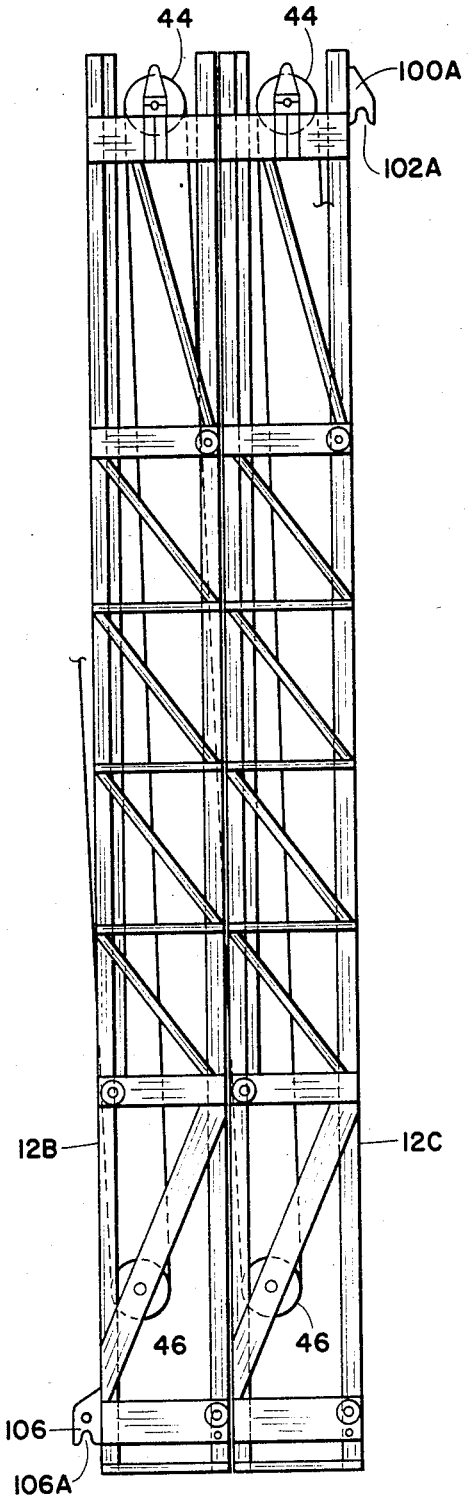
FIGS. 7 and 8 illustrate a corner column of the second and third elements in their nested position in FIG. 7 and in an extended position in FIG. 8.

Referring now to FIGS. 5 and 6, these represent a corner column of the first and second sections labeled 12A and 12B respectively. The construction of the columns for the first or base element is made much stronger than that for the successive upper corners, again because of the great weight carried by the floor in the bottom of the second element.

Referring to FIGS. 5 and 6, it will be noted near the top on the inside corner of the element 12A is a plate 100A having an inverted U-shaped slot 102A. This is welded to the top corner column 12A, but extends outwardly beyond the interface into the cross-sectional area of the corner column of the second element 12B. Also, near the bottom end of the corner 12B is a pin 104. This is welded to the frame of 12B. The purpose of this pin 104 is when the second element 12B is lifted that pin 104 will fit into the slot 102A and will not permit any further upward movement of the column 12B with respect to the column 12A. That would be an upper slot which would prevent the entire lifting of the second element out of the first element. There is at the bottom of column 12B a plate 106 similar to 100A. Also, near the top of 12A is an opening 108. With 12B raised and stopped by 104 and 102A, a drive pin is driven into opening 108. This pin passes through the U-shaped bracket 106 and firmly locks the column 12B in its raised position with respect to 12A.

Figure 12:
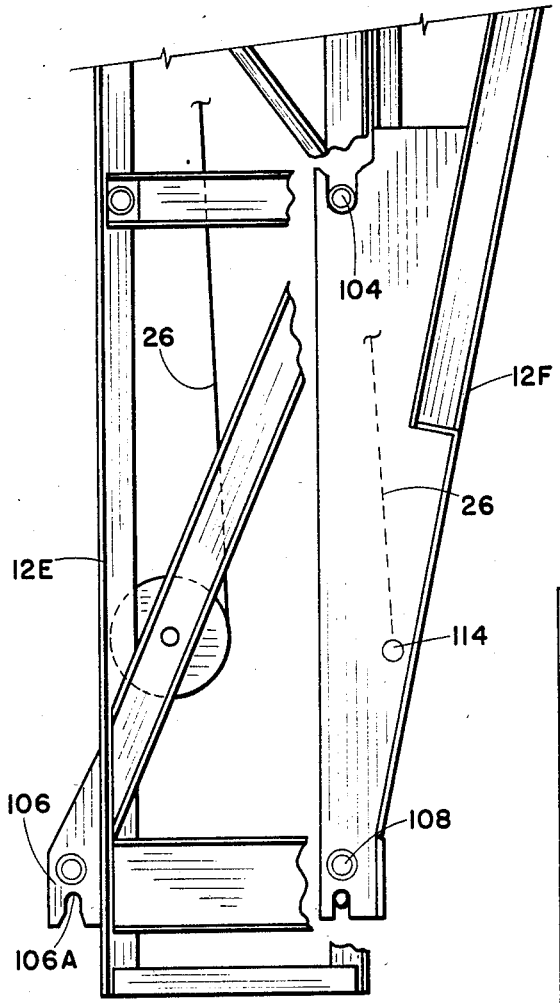
FIGS. 12 and 13 illustrate a detail of the corner of the (N−1)th and the Nth element in the nested position and in the raised position.

Referring now to FIG. 12 there is shown a corner column of the (N−1)th element, and there is a corresponding steel plate 106 extending out near the very bottom of the top section which has the same inverted U-shaped slot 106A. The purpose of this slot is so that when the top section is being lowered it can rest on a pin such as 108 in FIG. 6. The pin 108 is part of the corner 12A. Thus, the plate 100A near the top of the column 12A which would be the top stop and the pin 108 at the lower end of the column 12A would be the bottom stop, and these together would prevent the excessive upward movement or downward movement by providing the stops as described. Once they are in raised position; that is, the pin 104 is locked into the plate 100A, then the pin 108 can be put into the slot 106 of the bottom plate on the corner column 12B. By this means the two sections are positively locked to each other; that is, there is no way of raising one or lowering one with respect to the other, and there is no danger of the derrick collapsing. Consequently, after all of the elements are raised in position, these pins will be put in place so as to lock the various sections each to its own neighbors to provide a rugged, rigid mast.

Figure 13:
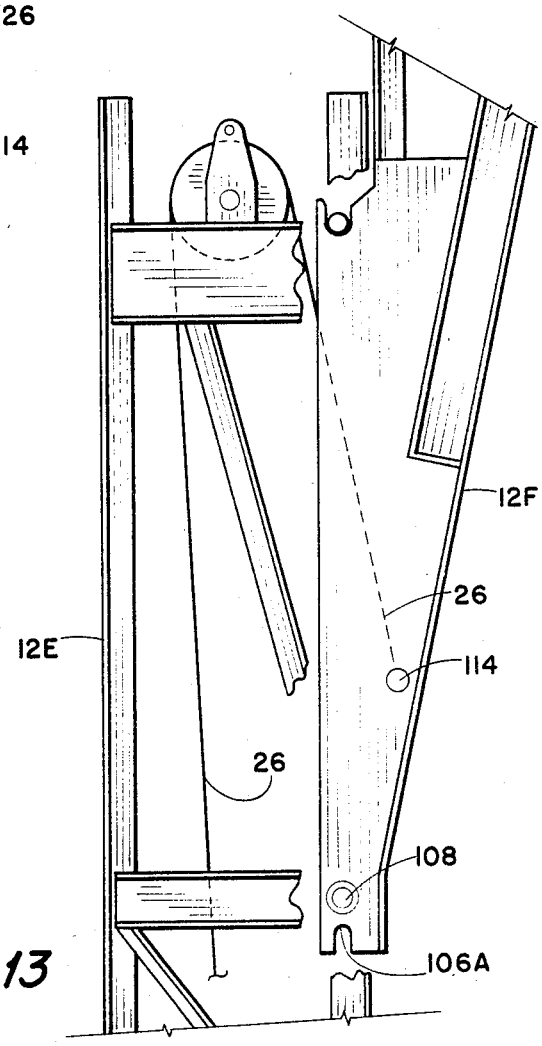

This locking arrangement is shown a little bit more clearly in connection with FIGS. 12 and 13. However, further description does not appear to be necessary.

One of the important parts of this mast is the apparatus for lifting the various sections in a selected order in erecting the mast. As has been described earlier, four separate lifting cables are used which are reeved through all of the pulleys in the corner columns of the elements. The first ends of the lifting cables are anchored to points 114 on the Nth element. The second ends of the lifting cable 26 go individually to one of the lifting cable drums 124, each of which has its own separate power source 120 which drives the drum 124 through a hydrostatic pump 121P and motor 121M, which are connected by pressure hose, as is well known in the art.

Figure 14:
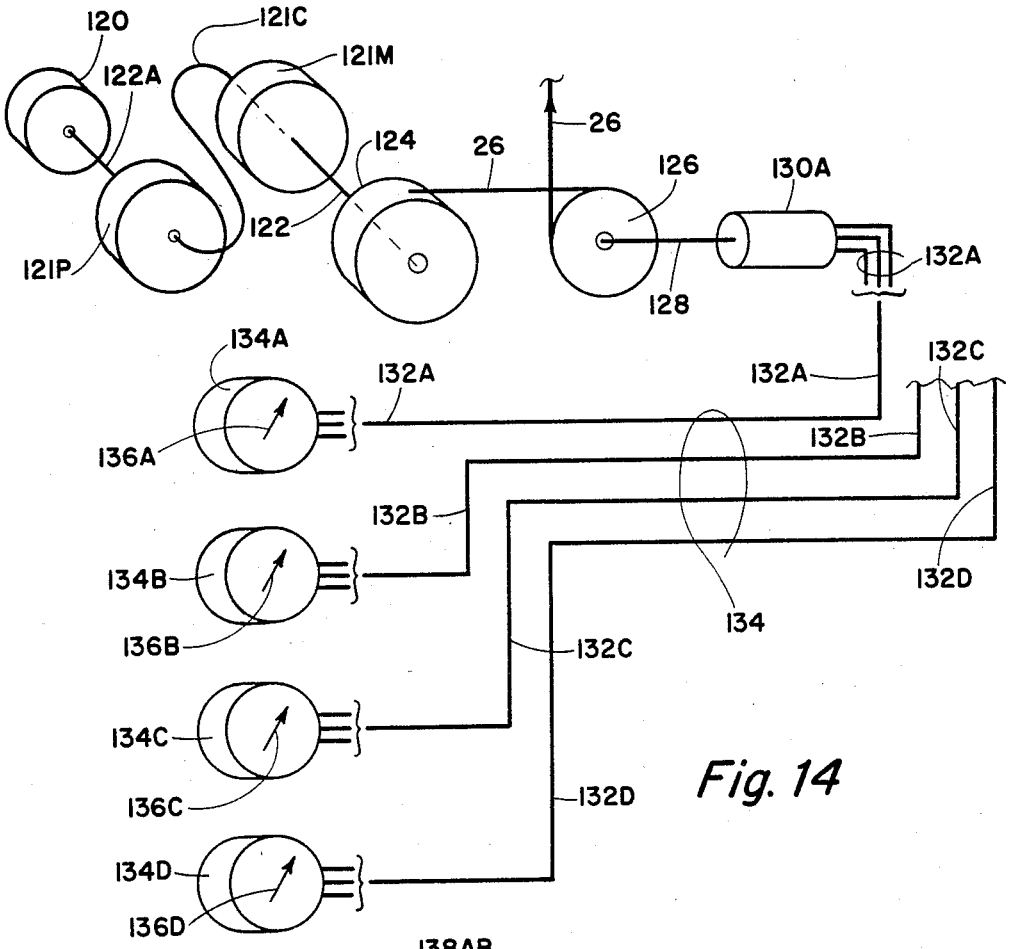
FIGS. 14 and 15 illustrate some of the detail of the control apparatus related to the lifting cables.
Figure 15:
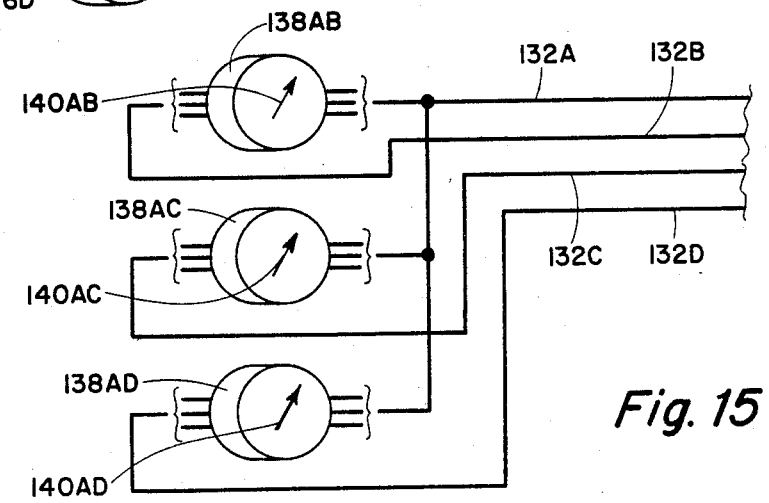

One of the important parts of the cable system is to control the power source so that each of the four cables travels at the same linear velocity as the others. This is illustrated in FIGS. 14 and 15. In FIG. 14 is shown a typical drive system with an engine or motor 120 driving a hydraulic pump 121P and hydraulic motor 121M to the cable drum 124. The lifting cable 26 is reeled on the drum 124. The cable then goes around an idler or lifting pulley 126 and to the other lifting pulleys by cable 26.

There is a Selsyn generator 130 that has an output of three phase voltages, which when connected to a Selsyn motor will cause the shaft of the motor to turn in synchronism with the drive shaft 128 of the Selsyn generator 130. When all the four Selsyn generators are connected to appropriate Selsyn motors 134A, 134B, 134C, 134D and a reference arrow or other display is shown, all the displays should turn in synchronism.

A preferred method of display and control is to use differential Selsyn motors 138 A-D, for example. This differential motor has three phase windings on both stator and rotor. Applying signals from generator 130A to one winding and the second generator 130B to the other winding, the rotor shaft will turn at a rate equal to the difference in rates of the two generators. This is shown in FIG. 15. Here all the displays (arrows) on the shafts of the three Selsyn differential motors (SDM) would represent the relative rotation between pulley 126A to each of the others.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed is:

1. A vertical axis, telescoping derrick or mast of rectangular cross-section, for drilling deep boreholes in the earth, comprising:

a first or outer base unit comprising a rectangular four-walled enclosure, having selected horizontal dimensions and having a support column in each corner;

a second liftable derrick element comprising a four-walled parallelepiped having a support column in each corner, and open at the top, the bottom having a floor therein, the second element being of rectangular horizontal cross-section similar to that of said base unit, and of such dimension as to be vertically coaxially slidable inside of said base unit, and having stop means to limit the upward travel of said second element;

at least a third innermost liftable derrick element comprising a four-walled parallelepiped open at top and bottom, of rectangular horizontal cross-section similar to that of said second element, and of such dimensions as to be vertically, coaxially slidable inside of said second element, and having means to limit the upward travel of said second element;

drum and cable means to lift said third element with respect to said second element, and to lift said second element with respect to said base unit, in which said cable means is operated in the corner columns of each of the adjacent derrick elements, and each corner column having at the top and bottom thereof at least one pulley and in which the floor of the second element supports a rotary table and drawworks and including at the top of the columns in said base unit and the bottom of the columns in said second derrick element at least a second lifting pulley whereby there will be at least three loops of cables supporting each corner of said second derrick element;

a vertical plate attached adjacent the bottom of each corner column of each derrick element projecting outside the outer contour of said column and having an upwardly directed slot;

a corresponding removable horizontal pin positioned inside the contour of and adjacent the top of the base unit and each derrick element except the innermost corner column of the uppermost element and adapted to fit into said slot of said plate of the next adjacent inner derrick unit as it is raised in place with respect to the next adjacent outer derrick unit to thereby lock each raised element to the next lower element.

2. The derrick as in claim 1 in which said means to lift includes four separate cable means, each adapted to lift one corner of each of said elements.

3. The derrick as in claim 2 and including means to control said four cable means so that they all move in synchronism.

4. The derrick as in claim 3 in which said four cables are each on one of four drums driven by engine or motor means, and at least indicator means for displaying a function of the speed of travel of each of said four cables, and means to control the speed of rotation of each of said drums;

whereby the speeds of each of said cables can be made the same.

5. The derrick as in claim 3 and including in association with one engine, connected to one cable drum and one cable, and further including:

(a) four lifting pulleys each driven by one of said cables;

(b) four means each driven by one of said lifting pulleys to provide indication of the angle of rotation of said pulley; and (c) means to compare the rates of rotation of each of said means to provide indication.

6. The derrick as in claim 5 in which said means to provide indication for each cable comprises:

(a) synchronous generator means driven by said pulley;

(b) synchronous motor means driven by said synchronous generator means; and (c) display means driven by the shaft of said motor.

7. The derrick as in claim 6 in which said synchronous generator means comprises Selsyn generator means, said synchronous motor means comprises Selsyn motor means; and said display means comprises display means attached to the shaft of said Selsyn motor means.

8. The derrick as in claim 6 in which said synchronous motor means comprises Selsyn Differential Motor means (SDM):

(a) one set of windings on each of said SDMs connected to one of said generator means;

the outputs of each of said four generator means connected respectively to each of the second windings of said SDM;

whereby the rotations of each of the four shafts of said SDM will indicate the degree of synchronism of said four lifting cables.

9. The derrick as in claim 1 in which each of said cables is operated in one of the corner columns of each of the adjacent sections, and each corner column has at top and bottom at least one pulley positioned in a diagonal plane at the tops of said columns and at the bottoms of said columns;

whereby all said lifting pulleys in each column will be in the same plane.

* * * * *